US005577934A

United States Patent [19]

Yagi et al.

[11] Patent Number: 5,577,934

[45] Date of Patent: Nov. 26, 1996

[54] CONNECTOR ASSEMBLY

[75] Inventors: Sakai Yagi; Toru Nagano, both of Shizuoka-ken, Japan

[73] Assignee: Yazaki Corporation, Tokyo, Japan

[21] Appl. No.: 365,074

[22] Filed: Dec. 28, 1994

[30] Foreign Application Priority Data

Dec. 29, 1993 [JP] Japan ..... 5-352650

[51] Int. Cl.[6] ..... H01R 13/46

[52] U.S. Cl. ..... 439/540.1; 439/364

[58] Field of Search ..... 439/540.1, 364, 439/638, 639, 701

[56] References Cited

U.S. PATENT DOCUMENTS

| | | | |
|---|---|---|---|
| 4,923,411 | 5/1990 | Hayashi et al. | 439/638 |
| 5,000,693 | 3/1991 | Hatagashi et al. . | |
| 5,288,246 | 2/1994 | Whiteman, Jr. et al. | 439/540.1 |
| 5,295,856 | 3/1994 | Endo et al. | 439/364 |
| 5,419,721 | 5/1995 | Lignelet | 439/364 |
| 5,454,733 | 10/1995 | Watanabe et al. | 439/540.1 |

FOREIGN PATENT DOCUMENTS

| | | |
|---|---|---|
| 0326350 | 8/1989 | European Pat. Off. . |
| 6-223915 | 12/1994 | Japan . |

*Primary Examiner*—Stephen P. Garbe

*Attorney, Agent, or Firm*—Wigman, Cohen, Leitner & Myers, P.C.

[57] ABSTRACT

A connector assembly in which ribs in a conventional connector assembly are removed to eliminate evitable space, and the resistance against outer force is improved. The connector assembly includes: a frame with a plurality of connector accommodating holes extending in the same direction; and at least two types of connectors classified by size inserted into the plurality of connector accommodating holes and secured therein, wherein larger connectors are disposed at positions adjacent to a circumference of the frame, and smaller connectors are disposed at an interior position on the frame relative to the larger connectors.

12 Claims, 2 Drawing Sheets

CONNECTOR ASSEMBLY

BACKGROUND OF THE INVENTION

1. Field of the Invention

The present invention relates to a connector assembly, and more particularly to a connector assembly integral to frame in which a plurality of connectors are engaged with mated connectors at a stroke.

2. Description of the Related Art

Conventionally, practitioners have used a connector assembly which comprises: a rectangular frame made of a thick plate; a plurality of connecter accommodating holes extending in the same direction; a guide frame formed at the center of the frame; and a bolt mounted in the guide frame for connecting the connector assembly to a mated connector assembly. In the connector assembly, a plurality of connectors are inserted into the connector accommodating holes and secured therein in such a manner that the plurality of connectors project from the upper surface of the frame.

In order to protect the connectors projecting from this upper surface of the frame, vertically extending ribs are integrally formed with the frame at the four corners thereof. These ribs function as guides also when the connector assembly is connected to the mated connector assembly, which prevents gouge caused by the disposition of the connectors in the connecting operation since the ribs engaged reception portions of the mated connector assembly.

In particular, when the plurality of connectors are inserted into the connector accommodating holes from the side opposite to the side at which the connector assembly is mated, and the connectors abut and push the mated connector assembly with strong force, the connectors may be disconnected from the connector accommodating holes. Therefore, there is a requirement to eliminate unnecessary gouge by the ribs to prevent the connectors from being disconnected.

SUMMARY OF THE INVENTION

However, in the construction of the conventional connector assembly as described above, the frame should be enlarged by the height of the ribs, so that there is a problem in that the space for mounting parts in automobiles or the like is not effectively utilized. The present invention has been accomplished to eliminate the above drawbacks of the conventional connector assembly and the object thereof is to provide a connector assembly in which the ribs in the conventional connector assembly are removed to eliminate evitable space, and the resistance against outer force is improved.

A connector assembly according to the present invention comprises: a frame with a plurality of connector accommodating holes extending in the same direction; and at least two types of connectors classified by sizes inserted into the plurality of connector accommodating holes and secured therein, wherein larger connectors are disposed at positions adjacent to a circumference of the frame, and smaller connectors are disposed inside the larger connectors.

Another connector assembly according to the present invention comprises: a frame; at least two types of connectors classified by size mounted to the frame with tip portions of the connectors projecting from a surface of the frame in the same direction; and housings of larger connectors integrally formed with the frame; wherein larger connectors are disposed at positions adjacent to a circumference of the frame, and smaller connectors are disposed inside the larger connectors.

As another aspect of the present invention, in the above-mentioned connector assembly, the height of the larger connector from the surface of the frame is set higher than that of the smaller connector.

Further, as another aspect of the present invention, in the aforementioned connector assembly, the connectors are inserted from the side opposite to the side at which the connector assembly is connected to a mated connector assembly.

Still, as a further aspect of the present invention, in the connector assembly described above, securing means is provided at the center of the frame to connect the connector assembly to the mated connector assembly, and the height of the securing means from the surface of the frame is higher than that of the small connector.

BRIEF DESCRIPTION OF THE DRAWINGS

The present invention will be more apparent from the following description with reference to the accompanying drawing wherein.

DETAILED DESCRIPTION OF PREFERRED EMBODIMENTS

A connector assembly according to an embodiment of the present invention will be explained with reference to drawings.

Figure 1:
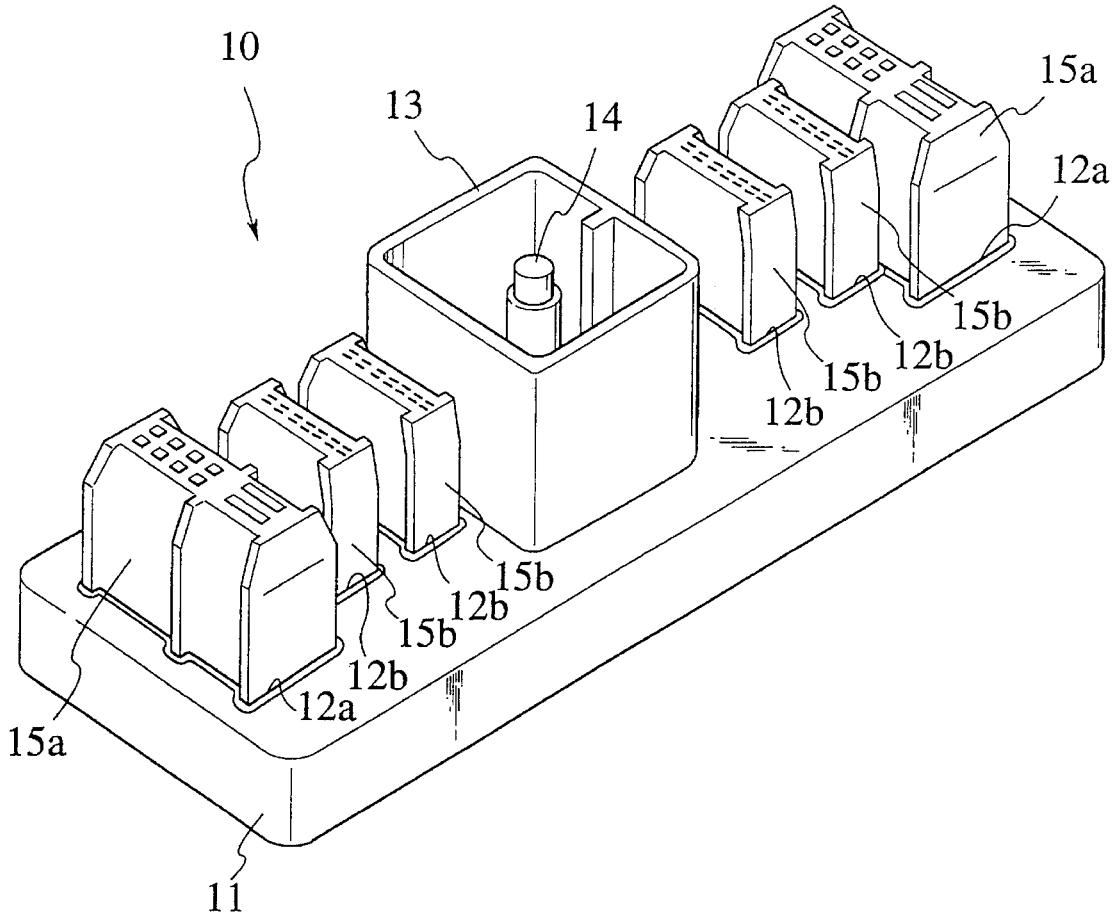
FIG. 1 is a perspective view of a connector assembly according to the first embodiment of the present invention.

FIG. 1 is a perspective view of a connector assembly according the first embodiment of the present invention. The connector assembly 10 is provided with a rectangular frame 11 made of thick plate. On the frame 11, large connector accommodating holes 12*a* and small connector accommodating holes 12*b* extending in the direction perpendicular to the surface of the frame 11 are disposed in a line in the longitudinal direction of the frame in a predetermined order. A rectangular guide frame (guide projection) 13 is formed at the center of the upper surface of the frame, and is engaged with a mated guide projection when the connector assembly 10 is connected to the mated connector assembly. A bolt (securing means) 14 is mounted in the guide frame The connector accommodating holes 12*a* and 12*b* are symmetrically disposed right and left with the guide frame 13 in between. The large connector accommodating holes 12*a* are situated at outermost positions of the frame 11 and two small connector accommodating holes are disposed between the large hole 12*a* and the guide frame 13. Large male connectors 15*a* and small male connectors 15*b* are inserted into the large and small connector accommodating holes 12*a*, 12*b* and secured therein respectively, and tip portions of those male connectors 15*a*, 15*b* project from the upper surface of the frame 11.

The large male connectors 15*a* are larger than the small male connectors 15*b* in dimensions, that is, in width, height and the like. As a result, the large male connector 15*a* is provided with a wider contact area against the frame 11 in comparison with the small male connector 15*b*, therefore, the large male connector is fixed to the frame 11 more securely through engaging means not shown. Similarly, the small male connectors 15*b* are secured to the frame 11 by engaging means not shown. The height of the small male connectors is lower than that of the guide frame 13, so it is said that the small connectors are situated at a valley between the large male connector 15*a* and the guide frame 13 as mountains. As a result, the small male connectors 15*b* are protected by the large male connectors 15*a*, which are securely fixed to the frame 11, and by the guide frame 13.

When the connector assembly 10 is connected to the mated connector assembly, the guide frame 13 is inserted into a projection of the mated connector assembly, and the rotation of the bolt 14 causes the frame 11 to approach the mated connector assembly while maintaining correct posture by way of the guide frame 13. Then, the large male connectors 15*a* at the outermost positions of the frame 11 start connecting to female terminals of the mated connector assembly, and further rotation of the bolt 14 causes the small connector 15*b* to be connected to female connectors of the mated connector assembly, and finally all male connectors are connected to the mated female connectors. In this case, the small male connectors are guided and connected to the mated female connectors based on the motion of the large male connectors 15*a* in the engaging operation, which prevents the small male connectors from gouging the mated female connectors, resulting in a smooth engaging operation.

It is also possible to insert the large and small male connectors 15*a*, 15*b* into the connector accommodating holes from the rear side of the frame (the side opposite to the side at which the connector assembly is connected to the mated connector assembly), and selected male connectors may be disconnected from the connector accommodating holes. With the above-mentioned construction, when a male connector is selectively disconnected from the hole, a force is applied to the mated female connectors in the direction in which the male connecters are pulled off. However, this problem is also avoidable as the problem about the gouge is solved.

Figure 2:
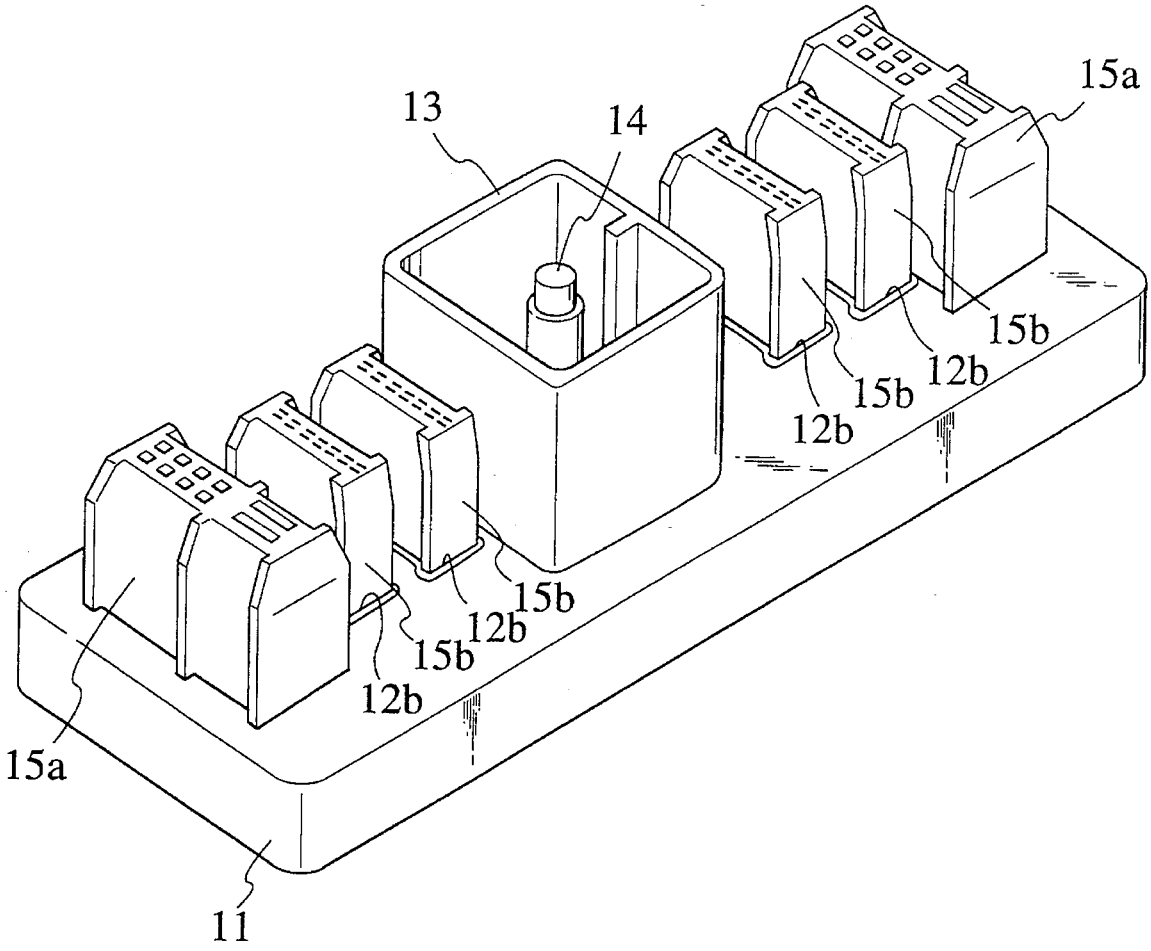
FIG. 2 is a perspective view of a connector assembly according to the second embodiment of the present invention.

FIG. 2 is a perspective view of a connector assembly according to the second embodiment of the present invention. In this connector assembly, the housings of the large connectors 15*a* are integrally formed with the frame 11. That is, no connecter accommodating hole for large male connector 15*a* is formed on the frame 11. Except for this, the construction of the connector assembly according to the second embodiment is the same as in the first embodiment.

In this embodiment, the housing of the large male connector 15*a* is integrally formed with the frame, which considerably strengthens the connection of the large male connector 15*a* in comparison with the first embodiment. As a result, the protection of the small male connectors 15*b* is further improved, and the aforementioned guiding action of the large male connectors 15*a* is also further improved.

In the embodiments described above, the bolt 14 is used as securing means; however, other securing means may be used in the present invention, and moreover no securing means may be acceptable.

Further, in the above-mentioned embodiments, the connectors are disposed in a line on the rectangular frame, and the large connectors are situated at outermost positions and tile small connectors are located inside the larger connectors. It may be possible to apply the present invention when the large and small connectors are longitudinally and laterally arranged on the frame. In such a case, the larger male connectors are disposed preferably at positions at the circumference of the frame and the small male connectors are arranged inside the large male connectors. Further, it may be possible to arrange the large male connectors at random but at least enclose the small male connectors. When three types of connectors classified by size are provided, it is best to arrange larger connectors from outside to inside in descending order. However, it is unnecessary to dispose medium connectors in size always between the largest male connectors and the smallest male connectors.

In the above-mentioned embodiment, the male connectors are mounted to the frame, but the female connectors may be mounted thereto.

With the construction of the connector assembly according to the first embodiment of the present invention, the large connectors themselves which are fixed to the frame with strong force to protect the small connectors. As a result, the ribs for protecting the small connectors, which are used in the conventional connector assembly, is unnecessary to the connector assembly according to the present invention, which allows the space occupied by the ribs to be eliminated, resulting in small connector in size, contributing to the effective utilization of the parts accommodating space.

Further, with the construction of the connector assembly according to the second embodiment of the present invention, the large connectors are fixed to the frame with considerably strong force, which more securely protects the small connecters from impact caused by outer force.

Further, in the present invention, tile small male connectors are guided and connected to the mated female connectors based on the motion of the large male connectors in the engaging operation, which prevents the small male connectors from gouging the mated female connectors.

It is also possible to insert the large and small male connectors into the connector accommodating holes from the rear side of the frame, and male connectors are selectively disconnected from the connector accommodating holes, resulting in smooth maintenance work of the connector assembly. In particular, when the gouge caused by the small connector is mitigated, the problem relating to the connectors being pulled off due to the gouge is also solved.

Further with a securing means at the center of the frame for connecting said connector assembly to the mated connector assembly, the small connectors are guided to the mated connectors and the gouge caused by the small connectors is more effectively mitigated.

What is claimed is:

1. A connector assembly, comprising:

a frame having a plurality of connector accommodating holes extending in the same direction therethrough; and at least two types of connectors classified by size inserted into said plurality of connector accommodating holes and secured therein;

wherein larger connectors are disposed at positions adjacent to a circumference of said frame, and smaller connectors are disposed at an interior position on said frame relative to said larger connectors;

wherein each said larger connector has a height, measured from a surface of said frame, which is greater than a height of each said smaller connector.

2. The connector assembly according to claim 1, wherein said connectors are inserted from a side opposite to a side that said connector assembly is connected to a mated connector assembly.

3. The connector assembly according to claim 1, further comprising securing means at the center of said frame for connecting said connector assembly to a mated connector assembly, wherein said securing means has a height, measured from a surface of the frame, which is greater than a height of each said smaller connector.

4. A connector assembly, comprising:

a frame;

at least two types of connectors classified by size mounted to said frame and having tip portions thereof projecting frown a surface of the frame in the same direction; and housings of larger connectors integrally formed with said frame;

wherein larger connectors are disposed at positions adjacent to a circumference of said frame, and smaller connectors are disposed at an interior position on said frame relative to said larger connectors.

5. The connector assembly according to claim 4, wherein said larger connector has a height, measured from a surface of said frame, which is greater than a height of each said smaller connector.

6. The connector assembly according claim 4, wherein said connectors are inserted from a side opposite to a side that said connector assembly is connected to a mated connector assembly.

7. The connector assembly according to claim 4, further comprising securing means at a center of said frame for connecting said connector assembly to a mated connector assembly, wherein said securing means has a height, measured from a surface of the frame, which is greater than a height of each said smaller connector.

8. A connector assembly, comprising:

a frame having a plurality of connector accommodating holes extending in the same direction therethrough;

a least two types of connectors classified by size inserted into said plurality of connector accommodating holes and secured therein; and a rectangular guide frame centrally disposed on a surface of said frame;

wherein larger connectors are disposed at positions adjacent to a circumference of said frame, and smaller connectors are disposed between said rectangular guide frame and said larger connectors.

9. The connector assembly according to claim 8, wherein each said larger connector has a height, measured from a surface of said frame, which is greater than a height of each said smaller connector.

10. The connector assembly according to claim 8, wherein said rectangular guide frame has a height, measured front a surface of said frame, which is greater than a height of each said smaller connector.

11. The connector assembly according to claim 4, further comprising a rectangular guide frame centrally disposed on said frame.

12. The connector assembly according to claim 11, wherein said rectangular guide frame has a height, measured from a surface of said frame which is greater than a height of each said smaller connector.

* * * * *